US009064655B2

(12) United States Patent
Bonnstauffer

(10) Patent No.: US 9,064,655 B2
(45) Date of Patent: Jun. 23, 2015

(54) INPUT DEVICE WITH GEL CONTAINING CHAMBERS IN KEY CAP

(71) Applicant: William Bonnstauffer, Staten Island, NY (US)

(72) Inventor: William Bonnstauffer, Staten Island, NY (US)

( * ) Notice: Subject to any disclaimer, the term of this patent is extended or adjusted under 35 U.S.C. 154(b) by 0 days.

(21) Appl. No.: 14/299,384

(22) Filed: Jun. 9, 2014

(65) Prior Publication Data

US 2014/0299458 A1 Oct. 9, 2014

Related U.S. Application Data

(63) Continuation-in-part of application No. 14/217,823, filed on Mar. 18, 2014.

(60) Provisional application No. 61/807,984, filed on Apr. 3, 2013.

(51) Int. Cl.

| | |
|---|---|
| ***H01H 13/14*** | (2006.01) |
| ***H01H 13/705*** | (2006.01) |
| ***H01H 3/12*** | (2006.01) |
| ***H01H 13/84*** | (2006.01) |
| ***G10C 3/12*** | (2006.01) |
| ***H01H 13/85*** | (2006.01) |
| ***H01H 13/02*** | (2006.01) |
| ***H01H 13/70*** | (2006.01) |

(52) U.S. Cl.

CPC ..... *H01H 13/85* (2013.01); *H01H 13/02* (2013.01); *H01H 13/70* (2013.01); *H01H 13/84* (2013.01); *H01H 2217/044* (2013.01); *H01H 13/14* (2013.01); *H01H 13/705* (2013.01); *G10C 3/12* (2013.01); *G10C 3/125* (2013.01); *H01H 3/12* (2013.01); *H01H 2215/054* (2013.01); *H01H 2221/036* (2013.01); *H01H 2221/082* (2013.01); *H01H 2231/002* (2013.01); *H01H 2235/01* (2013.01)

(58) Field of Classification Search

CPC ..... H01H 2217/024; H01H 2217/016; H01H 13/84; H01H 13/85; H01H 3/12; H01H 3/122; H01H 13/705; H01H 13/7065; H01H 2003/127; H01H 2233/07; H01H 2217/044; G06F 3/0202; G10H 2220/311; G10H 1/344; G10H 1/346; G10C 3/12; G10C 3/125

See application file for complete search history.

(56) References Cited

U.S. PATENT DOCUMENTS

| | | | | |
|---|---|---|---|---|
| 4,400,594 A * | 8/1983 | Serras-Paulet | ..... | 200/5 A |
| 4,440,992 A * | 4/1984 | Desmarais | ..... | 200/517 |
| 4,803,316 A * | 2/1989 | Hayashi et al. | ..... | 200/406 |
| 5,209,588 A | 5/1993 | Chen | | |

(Continued)

OTHER PUBLICATIONS

International Search Report and Written Opinion dated Jan. 26, 2015 in related PCT Application No. PCT/US14/41785, filed Jun. 10, 2014 (8 pages).

*Primary Examiner* — Daniel J Colilla
(74) *Attorney, Agent, or Firm* — Dentons US LLP

(57) ABSTRACT

A device is provided. The device includes a first T-shaped structure defined via a first leg and a first platform. The device further includes a key cap with an interior open chamber. The cap is mounted onto the first structure such that the chamber contains the first platform. The device also includes a second T-shaped structure defined via a second leg and a second platform. The first leg vertically moves within the second leg such that the cap travels between a non-pressed position and a pressed position. The cap is raised above the second platform in the non-pressed position. The cap is in contact with the second platform in the pressed position.

20 Claims, 12 Drawing Sheets

(56) References Cited

U.S. PATENT DOCUMENTS

| | | | | |
|---|---|---|---|---|
| 5,290,115 | A | 3/1994 | Little | |
| 5,372,442 | A | 12/1994 | Wang | |
| 5,575,576 | A | 11/1996 | Roysden, Jr. | |
| 5,813,777 | A | 9/1998 | Bonnstauffer | |
| 5,933,133 | A | 8/1999 | Lohr | |
| 6,497,521 | B1 | 12/2002 | Lohr | |
| 6,705,783 | B1 * | 3/2004 | Bowen | 400/472 |
| 7,040,824 | B2 | 5/2006 | Schaffner | |
| 8,132,976 | B2 | 3/2012 | Odell et al. | |
| 8,278,579 | B2 | 10/2012 | Lin et al. | 200/517 |
| 2004/0123728 | A1 * | 7/2004 | Inoue | 84/719 |
| 2006/0056898 | A1 | 3/2006 | Schaffner | 400/491 |
| 2007/0065215 | A1 | 3/2007 | Brown | |
| 2008/0105106 | A1 * | 5/2008 | Osuga | 84/437 |
| 2008/0131184 | A1 | 6/2008 | Brown et al. | |
| 2008/0205961 | A1 | 8/2008 | Stachurski | |
| 2011/0298705 | A1 * | 12/2011 | Vaganov | 345/156 |

* cited by examiner

INPUT DEVICE WITH GEL CONTAINING CHAMBERS IN KEY CAP

CROSS-REFERENCE TO RELATED APPLICATIONS

The present application is a continuation-in-part (CIP) of U.S. patent application Ser. No. 14/217,823, filed on Mar. 18, 2014, which in turn claims priority to U.S. Provisional Patent Application Ser. No. 61/807,984, filed on Apr. 3, 2013. All of the above applications are herein fully incorporated by reference for all purposes.

TECHNICAL FIELD

Generally, the present disclosure relates to input technologies. More particularly, the present disclosure relates to user input mechanisms.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure may be concerned with. Further, nothing is disclaimed.

A conventional computer keyboard contains a plurality of symbolically labeled buttons, which are commonly known as keys, arranged according to a predefined layout, such as QWERTY. However, the buttons are usually not user ergonomic, which can result in finger discomfort based on repeated use.

BRIEF SUMMARY

The present disclosure may at least partially address at least one of the above. However, the present disclosure may prove useful to other technical areas. Therefore, the claims should not be construed as necessarily limited to addressing any of the above.

According to an example embodiment of the present disclosure a device is provided. The device includes a first T-shaped structure defined via a first leg and a first platform. The device further includes a key cap with an interior open chamber. The cap is mounted onto the first structure such that the chamber contains the first platform. The device also includes a second T-shaped structure defined via a second leg and a second platform. The first leg vertically moves within the second leg such that the cap travels between a non-pressed position and a pressed position. The cap is raised above the second platform in the non-pressed position. The cap is in contact with the second platform in the pressed position.

According to another example embodiment of the present disclosure a typing keyboard is provided. The keyboard includes a first T-shaped structure defined via a first leg and a first platform. The keyboard further includes a key cap with an interior open chamber. The cap is mounted onto the first structure such that the chamber contains the first platform. The keyboard also includes a second T-shaped structure defined via a second leg and a second platform. The first leg vertically moves within the second leg such that the cap travels between a non-pressed position and a pressed position. The cap is raised above the second platform in the non-pressed position. The cap is in contact with the second platform in the pressed position.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF THE PREFERRED EMBODIMENTS

Figure 1:
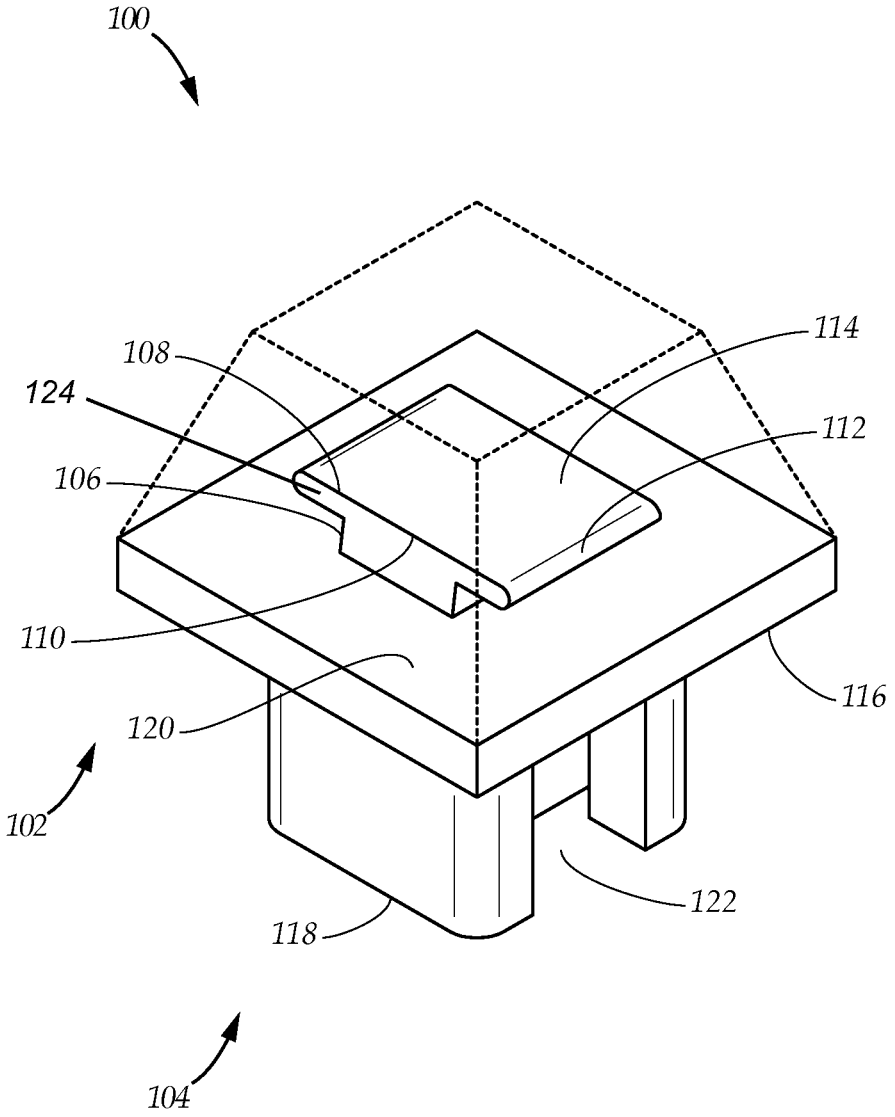
FIG. 1 shows a perspective view of an example embodiment of a key mechanism according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art. In addition, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments only and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, reflection, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, elastic, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

FIG. 1 shows a perspective view of an example embodiment of a key mechanism according to the present disclosure. A key mechanism 100 includes a first T-shaped structure 102 and a second T-shaped structure 104. At least one of the first structure 102 and the second structure 104 includes at least one of plastic, metal, wood, glass, and rubber.

The structure 102 is defined via a first leg 106 and a first platform 108 extending from the leg 106. The leg 106 and the platform 108 are unitary with each other. In another embodiment, the leg 106 and the platform 108 are assembled with each other, such as via fastening, magnetizing, adhering, mating, interlocking, and others. In other embodiments, the leg 106 extends through and past the platform 108.

The platform 108 has a pair of intermediate opposing side portions 110 flush with the leg 106. In another embodiment, one of the portions 110 is not flush with the leg 106 and that portion 110 extends away from at least one of the leg 106 and the platform 108 such that when viewed from above the platform 108, then the platform 108 and that portion 110 are T-shaped. When the platform 108 includes two opposing portions 110 extending from at least one of the leg 106 and the platform 108, then the platform 108 and those portions 110 are plus sign shaped (+). Yet in other embodiments, the platform 108 is shaped differently when viewed from the above the platform 108, such as a disc, an triangle, an oval, and others.

The platform 108 is defined via a pair of opposing arms 124 extending from the leg 106, where the arms 124 include a pair of end portions 112. The platform 108 also includes an upper side 114 spanning between the portions 112. The side 114 is level and smoothly flat, but in other embodiments, the side 114 is at least one of uneven, concave, convex, and rugged. The platform 108 is solid, but in other embodiments, the platform 108 is perforated. The platform 108 is rigid, but in other embodiments, the platform 108 is flexible.

The platform 108 is cuboid shaped, but in other embodiments, the platform 108 is shaped differently, such as a frustum, a cube, an ovoid, and others. Also, note that the platform 108 is unitary, but in other embodiments, the platform 108 is assembled, such as via fastening, magnetizing, adhering, mating, interlocking, and others.

The leg 106 is unitary, but in other embodiments, the leg 106 is assembled, such as via fastening, magnetizing, adhering, mating, interlocking, and others. The leg 106 is solid, but in other embodiments, the leg 106 is hollow. The leg 106 is rigid, but in other embodiments, the leg 106 is flexible.

The structure 104 is defined via a second leg 118 and a second platform 116 extending from the leg 118. The leg 118 and the platform 116 are unitary with each other. In another embodiment, the leg 118 and the platform 116 are assembled with each other, such as via fastening, magnetizing, adhering, mating, interlocking, and others. In another embodiment, the platform 116 has a pair of intermediate side portions, such as the portions 110, flush with the leg 118, as described herein. The platform 116 also includes an upper side 120 extending thereabout. The side 120 is level and smoothly flat, but in other embodiments, the side 120 is at least one of uneven, concave, convex, and rugged. The platform 116 is perimetrically greater than the platform 108, such as via having a greater perimeter. In other embodiments, the platform 108 is at least perimetrically identical to the platform 116. The platform 116 has a greater area than the platform 108. In other embodiments, the platform 108 has at least identical area to the platform 116. The platform 116 is solid, but in other embodiments, the platform 116 is perforated. The platform 116 is cuboid shaped, but in other embodiments, the platform 116 is shaped differently, such as a frustum, a cube, an ovoid, and others. Also, note that the platform 116 is unitary, but in other embodiments, the platform 116 is assembled, such as via fastening, magnetizing, adhering, mating, interlocking, and others. The platform 116 is rigid, but in other embodiments, the platform 116 is flexible.

The leg 118 is unitary, but in other embodiments, the leg 118 is assembled, such as via fastening, magnetizing, adhering, mating, interlocking, and others. The leg 118 is parallelogram shaped, but in other embodiments, the leg 118 is shaped differently, such as a tubular cylinder. The leg 118 is rigid, but in other embodiments, the leg 118 is flexible.

The leg 118 is hollow. The leg 118 contains the leg 106 such that the leg 106 vertically moves within the leg 118 for allowing the platform 108 to vertically move toward the platform 116 and to vertically move away from the platform 116. The leg 118 defines an open section 122 through which the first leg 106 is accessible, such as at least visually. For example, when the leg 106 vertically moves within the leg 118, then the vertical movement of the leg 106 is visible through section 122. In another embodiment, the leg 118 lacks the section 122 so that the leg 106 is not laterally accessible, such as visually. In other embodiments, the leg 118 includes at least two of the sections 122 on opposing sides of the leg 118. The section 122 extends from the platform 116 until a base portion of the leg 118. In another embodiment, the section 122 extends differently, such as from the platform 116 until midway of the leg 118.

Figure 2:
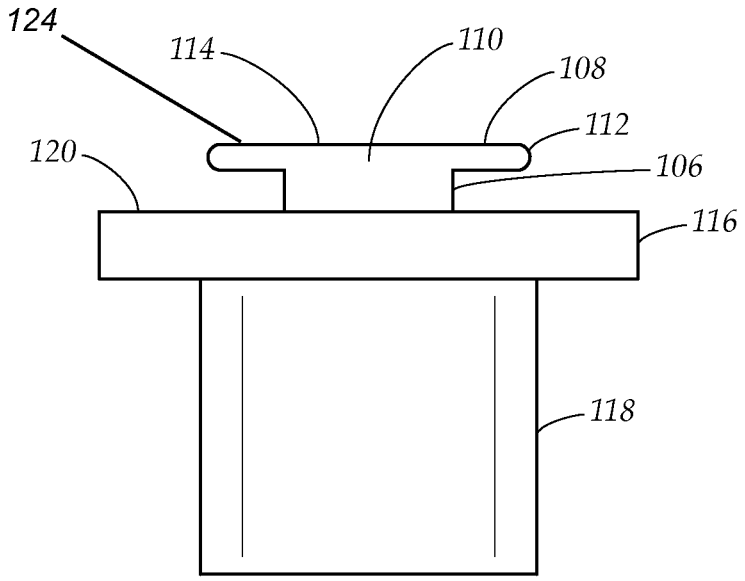
FIG. 2 shows a profile view of an example embodiment of a key mechanism according to the present disclosure.

FIG. 2 shows a profile view of an example embodiment of a key mechanism according to the present disclosure. Some elements of this figure are described above. Thus, same reference characters identify identical and/or like components described above and any repetitive detailed description thereof will hereinafter be omitted or simplified in order to avoid complication.

The leg 106 is hosted via the leg 118. The platform 116 is perimetrically greater than the platform 108. The arms 124 extend over the side 120.

Figure 3:
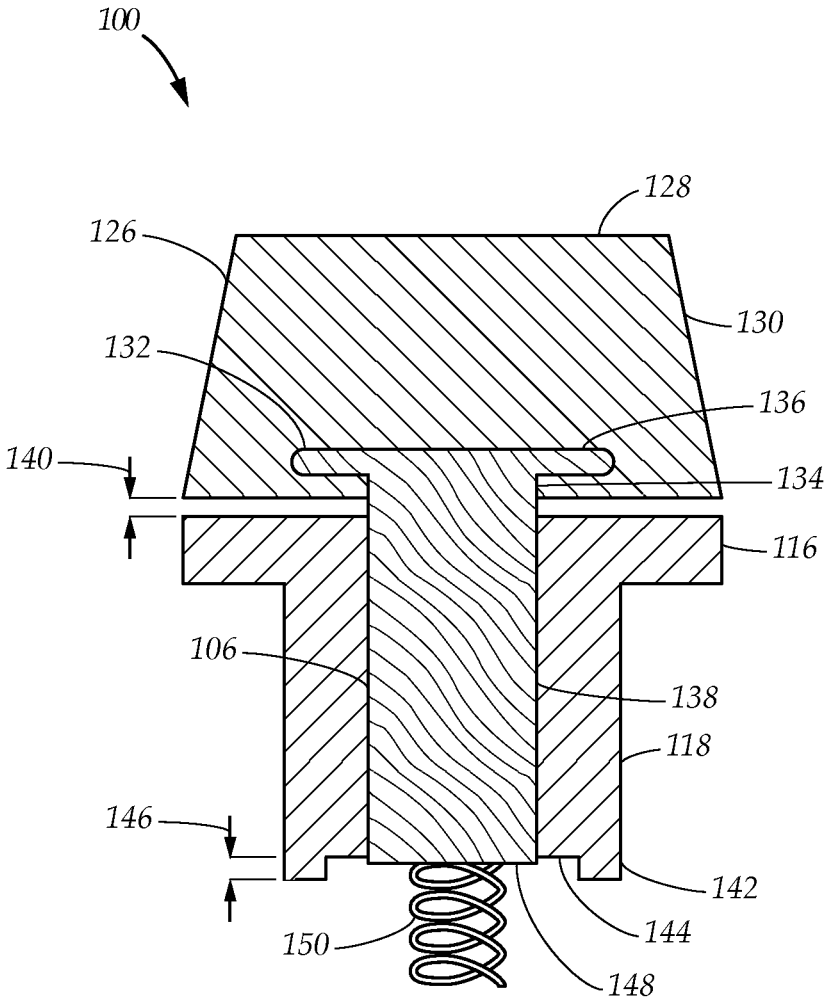
FIG. 3 shows a profile view of an example embodiment of a key cap in a non-pressed position according to the present disclosure.

FIG. 3 shows a profile view of an example embodiment of a key cap in a non-pressed position according to the present disclosure. Some elements of this figure are described above. Thus, same reference characters identify identical and/or like components described above and any repetitive detailed description thereof will hereinafter be omitted or simplified in order to avoid complication.

The mechanism 100 further includes a key cap 126 with an interior open chamber 132. The cap 126 is mounted onto the structure 102 such that the chamber 132 contains the platform 108. The cap 126 is elastic, such as via rubber, but in other embodiments, the cap 126 is rigid, such as via at least one of plastic, metal, glass, and wood. The cap 126 is frustum-shaped, but in other embodiments, the cap 126 is shaped differently, such as a cube, a cuboid, a sphere, an ovoid, a pyramid, a cone, and others.

The cap 126 has an upper side 128. The side 128 can include an alphanumeric symbol thereon, such as printed thereon, adhered thereon, embedded thereon, and so forth. The cap 126 includes a plurality of sidewalls 130 extending around the chamber 132. The chamber 132 includes a platform containing portion 136 and a leg containing portion 134 in fluid communication with the portion 136. The platform 108 is snugly contained within the portion 136. A portion of the leg 106 is snugly contained within the portion 134.

The leg 118 defines an inner channel 138 containing the leg 106. The leg 106 vertically moves within the channel 138 such that the cap 126 vertically travels between a non-pressed position and a pressed position. The leg 118 also has a lower side 148, which is in communication with an elastic member 150, such as a coiled spring. The member 150 is also in communication with another surface to provide for elastic feedback of the leg 106. The leg 106 further includes a base portion 144 and a leg portion 142 extending from the portion 144.

At rest, the cap 126 is in the non-pressed position, as shown in FIG. 3. The cap 126 is raised above the platform 116, as indicated via an open space 140. The cap 126 avoids contact with the platform 116 via the side 120. The side 148 is raised above a surface on which the legs 142 stand, as indicated via an open space 146. The side 148 avoids contact with the surface on which the legs 142 stand. The member 150 is in an expanded state.

Figure 4:
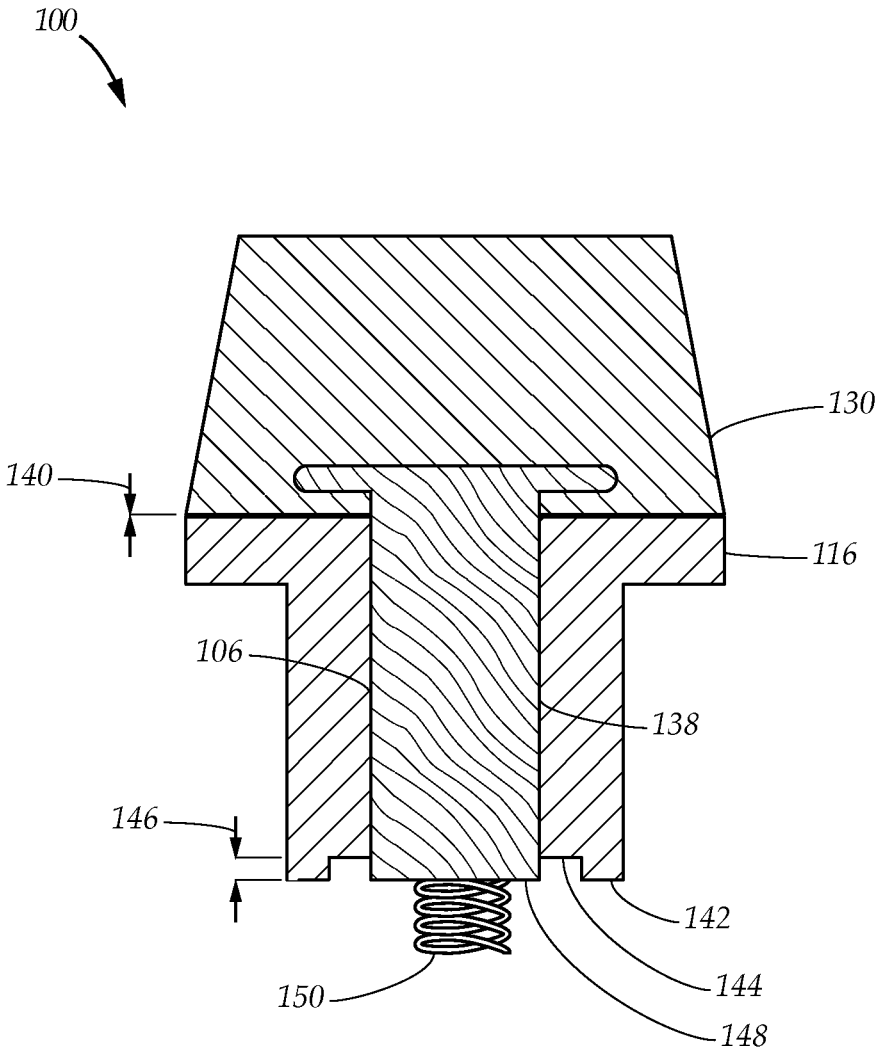
FIG. 4 shows a profile view of an example embodiment of a key cap in a pressed position according to the present disclosure.

FIG. 4 shows a profile view of an example embodiment of a key cap in a pressed position according to the present disclosure. Some elements of this figure are described above. Thus, same reference characters identify identical and/or like components described above and any repetitive detailed description thereof will hereinafter be omitted or simplified in order to avoid complication.

When a keyboard user applies a vertical force onto the side 128 for input purposes, the cap 126 vertically travels to the pressed position, as shown in FIG. 4. The cap 126 is not raised above the platform 116, as indicated via lack of the space 140. The cap 126 contacts the platform 116 via the side 120. The side 148 is not raised above the surface on which the legs 142 stand, as indicated via lack of the space 146. The side 148 contacts the surface on which the legs 142 stand. The member 150 is in a retracted state. The side 148 activates circuitry/mechanisms present on the surface on which the legs 142 stand to indicate an input of a symbol associated with the mechanism 100.

Figure 5:
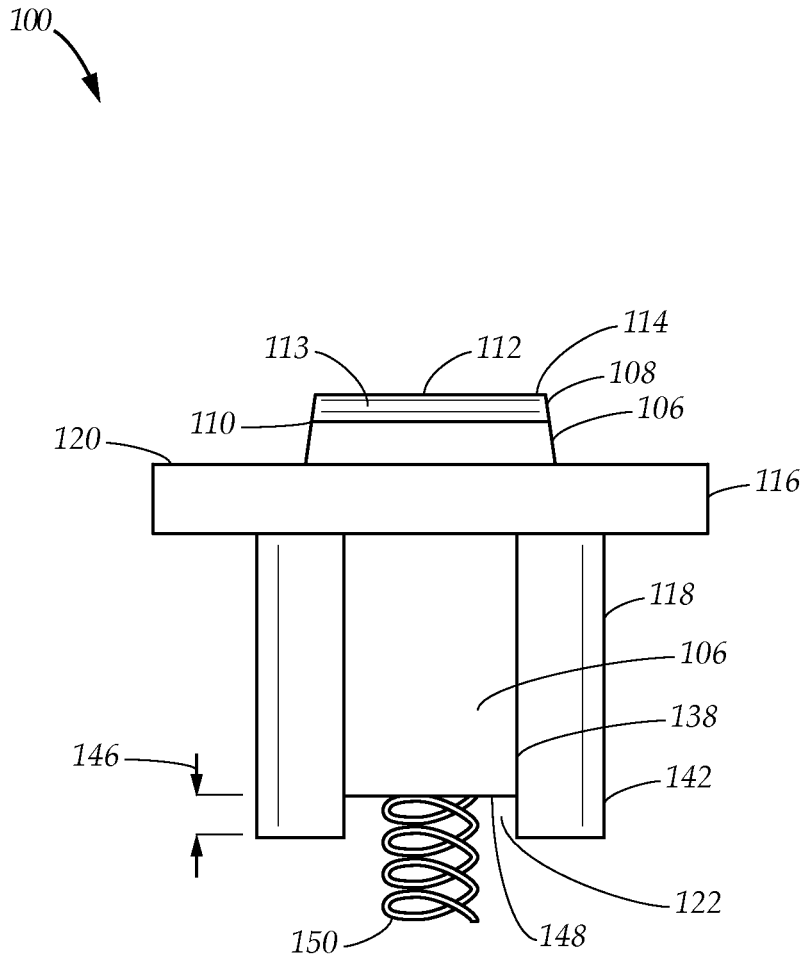
FIG. 5 shows another profile view of an example embodiment of a key mechanism according to the present disclosure.

FIG. 5 shows another profile view of an example embodiment of a key mechanism according to the present disclosure. Some elements of this figure are described above. Thus, same reference characters identify identical and/or like components described above and any repetitive detailed description thereof will hereinafter be omitted or simplified in order to avoid complication.

The leg 106 and the platform 108 have a trapezoidal profile view. In other embodiments, the leg 106 and the platform 108 have a different profile view, such as a rectangle. The portions 110 are flush with the leg 106. The arms 124 include a plurality of elongated protrusions 113 outwardly extending therefrom, away from the leg 106. The section 122 provides access to the leg 106. The channel 138 contains the leg 106. The side 148 is positioned such that the cap 126 would be in the non-pressed position. The member 150 is in the expanded state that the cap 126 would be in the non-pressed position. The side 148 is raised above the surface on which the legs 142 stand, as indicated via the space 146.

Figure 6:
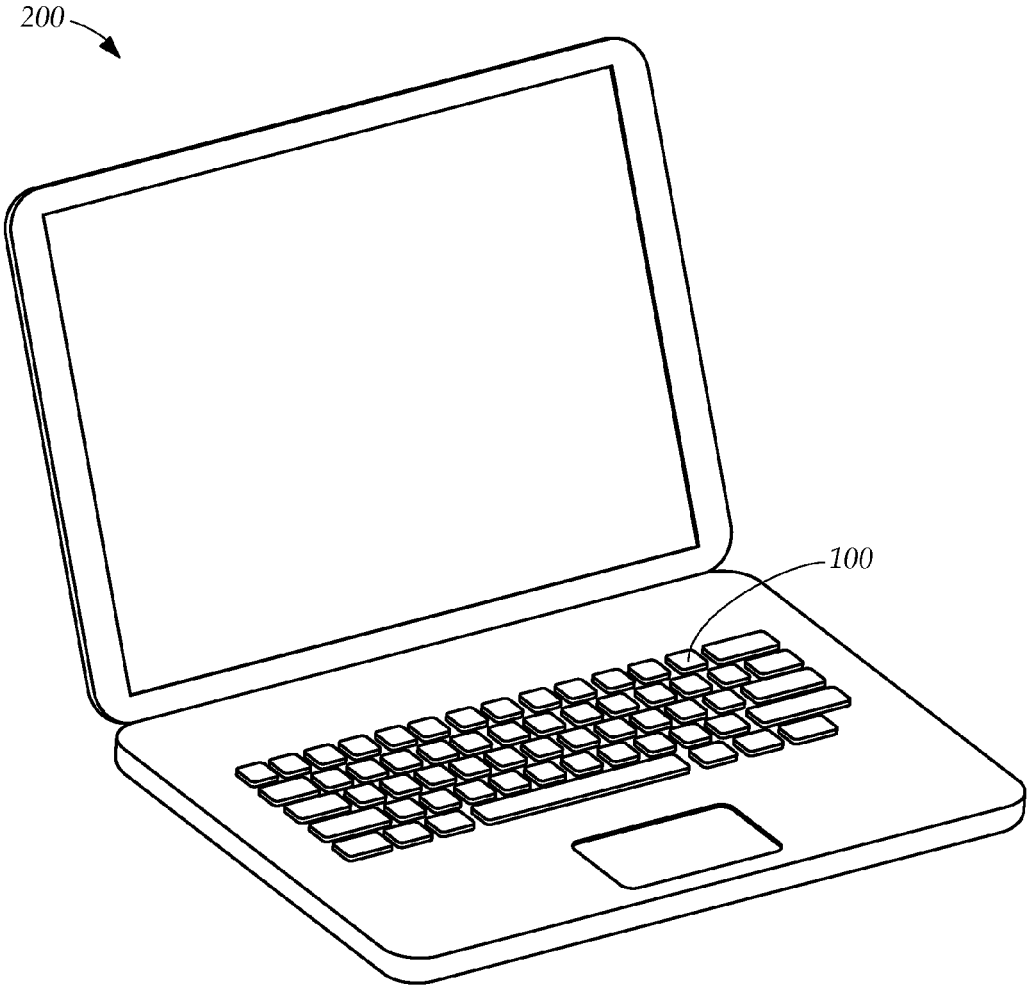
FIG. 6 shows a perspective view of an example embodiment a laptop computer containing a key mechanism according to the present disclosure.

FIG. 6 shows a perspective view of an example embodiment of a laptop computer containing a key mechanism according to the present disclosure. Some elements of this figure are described above. Thus, same reference characters identify identical and/or like components described above and any repetitive detailed description thereof will hereinafter be omitted or simplified in order to avoid complication.

A laptop computer 200 includes a keyboard with a plurality of keys. At least one of the keys is based on the mechanism 100.

Figure 7:
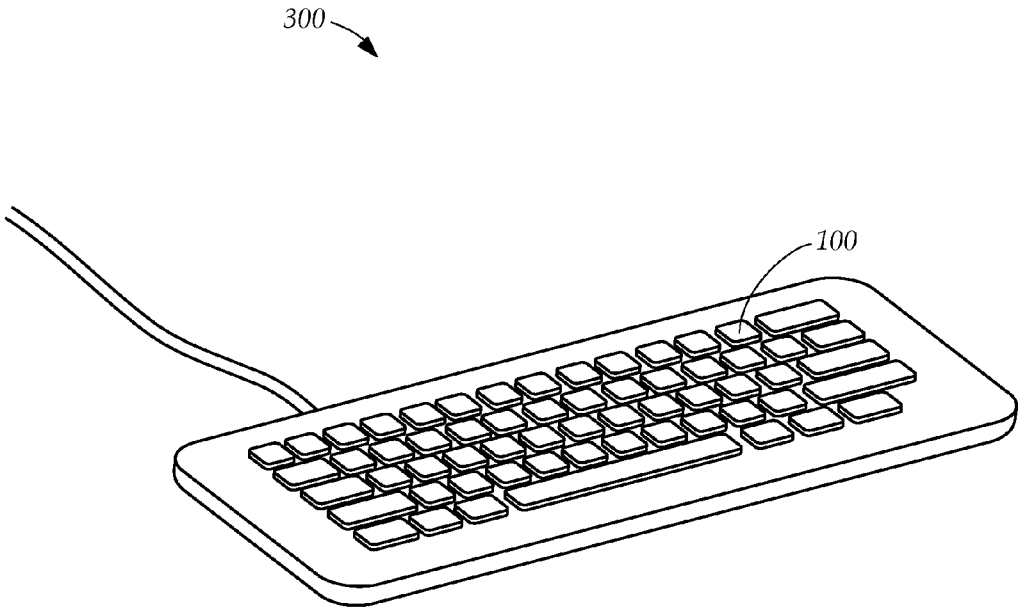
FIG. 7 shows a perspective view of an example embodiment of a wired keyboard containing a key mechanism according to the present disclosure.

FIG. 7 shows a perspective view of an example embodiment of a wired keyboard containing a key mechanism according to the present disclosure. Some elements of this figure are described above. Thus, same reference characters identify identical and/or like components described above and any repetitive detailed description thereof will hereinafter be omitted or simplified in order to avoid complication.

A wired keyboard 300 includes a plurality of keys. At least one of the keys is based on the mechanism 100.

Figure 8:
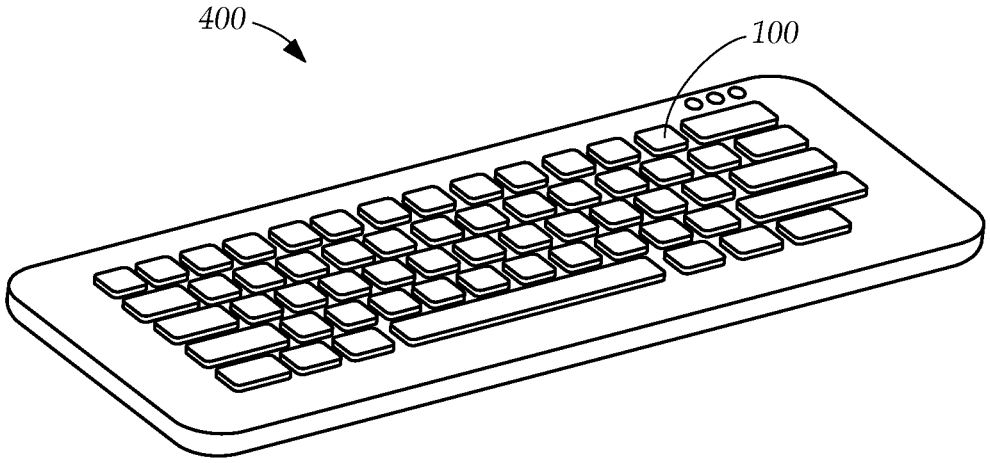
FIG. 8 shows a perspective view of an example embodiment of a wireless keyboard containing a key mechanism according to the present disclosure.

FIG. 8 shows a perspective view of an example embodiment of a wireless keyboard containing a key mechanism according to the present disclosure. Some elements of this figure are described above. Thus, same reference characters identify identical and/or like components described above and any repetitive detailed description thereof will hereinafter be omitted or simplified in order to avoid complication.

A wireless keyboard 400 includes a plurality of keys. At least one of the keys is based on the mechanism 100.

Figure 9:
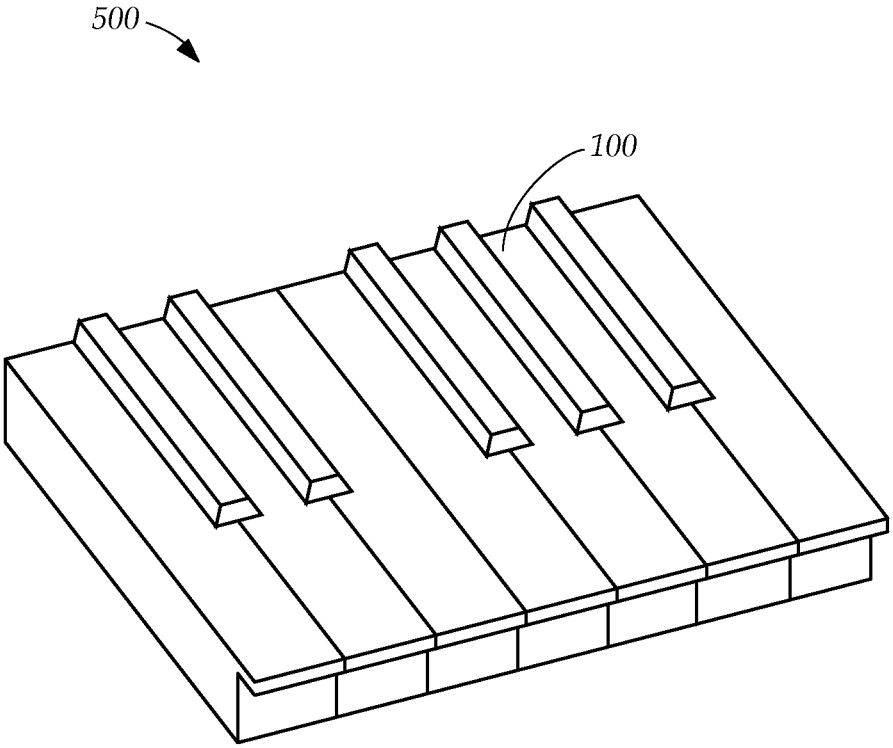
FIG. 9 shows a perspective view of an example embodiment of a piano keyboard containing a key mechanism according to the present disclosure.

FIG. 9 shows a perspective view of an example embodiment of a piano keyboard containing a key mechanism according to the present disclosure. Some elements of this figure are described above. Thus, same reference characters identify identical and/or like components described above and any repetitive detailed description thereof will hereinafter be omitted or simplified in order to avoid complication.

A piano keyboard 500 includes a plurality of keys. At least one of the keys is based on the mechanism 100.

Figure 10:
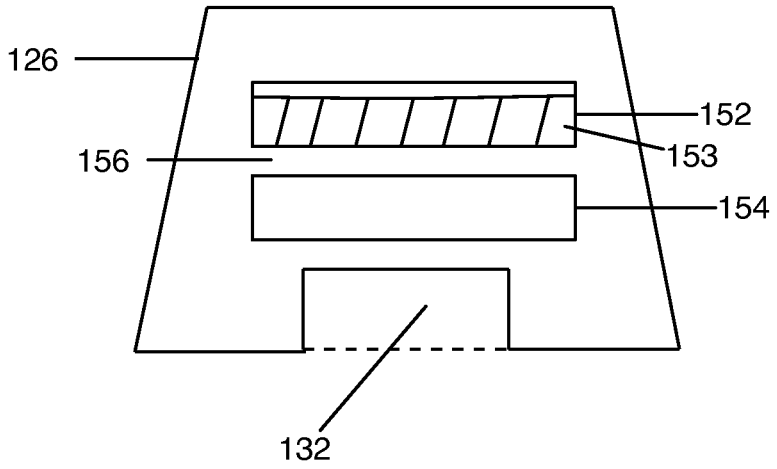
FIG. 10 shows a profile view of an example embodiment of a key cap containing a plurality of internal closed chambers according to the present disclosure.

FIG. 10 shows a profile view of an example embodiment of a key cap containing a plurality of internal closed chambers according to the present disclosure. Some elements of this figure are described above. Thus, same reference characters identify identical and/or like components described above and any repetitive detailed description thereof will hereinafter be omitted or simplified in order to avoid complication.

Cap 126 defines a first interior closed chamber 152, a second interior closed chamber 154, and an intermediate portion 156 interposed therebetween. At least one of the chamber 152 and the chamber 154 is cuboid, but can be shaped in another way, such as trapezoidal, ovoid, and others. The chamber 152 and the chamber 154 are volumetrically identical, but in other embodiments, the chamber 152 and the chamber 154 are volumetrically different. The chamber 132 is disposed underneath the chamber 152 and the chamber 154. The chamber 152 contains a gel 153, such as a cushioning gel. The chamber 154 is empty, but can contain the gel 153 as well or a different gel, whether in an identical or different volume. The gel 153 includes silicone. The chambers 152 and 154 are aligned, but can be misaligned as well.

Figure 11A:
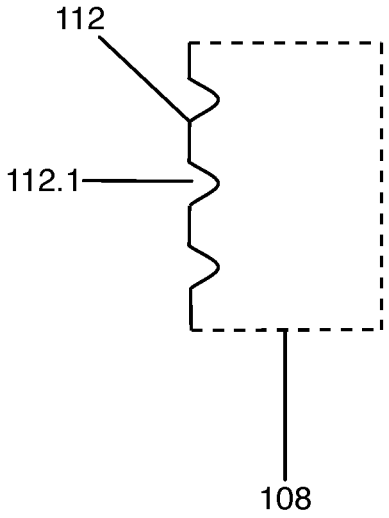
FIG. 11A shows a profile view of an example embodiment of a platform portion defining a plurality of depressions according to the present disclosure.

FIG. 11A shows a profile view of an example embodiment of a platform portion defining a plurality of depressions according to the present disclosure. Some elements of this figure are described above. Thus, same reference characters identify identical and/or like components described above and any repetitive detailed description thereof will hereinafter be omitted or simplified in order to avoid complication.

The platform 108 includes the portion 112, which defines a plurality of depressions 112.1 therein. The depressions 112.1 are identical to each other in shape and size. In other embodiments, the depressions 112.1 are different from each other in at least one of shape and size.

Figure 11B:
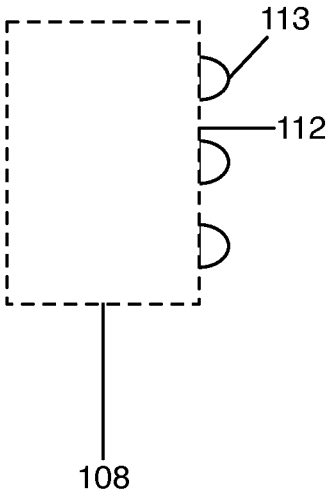
FIG. 11B shows a profile view of an example embodiment of a platform portion including a plurality of projections according to the present disclosure.

FIG. 11B shows a profile view of an example embodiment of a platform portion including a plurality of projections according to the present disclosure. Some elements of this figure are described above. Thus, same reference characters identify identical and/or like components described above and any repetitive detailed description thereof will hereinafter be omitted or simplified in order to avoid complication.

The platform 108 includes the portion 112, which includes the projections 113, which are elongated and hemispherical. The projections 113 are identical to each other in shape and size. In other embodiments, the projections 113 are different from each other in at least one of shape, such as cone-shaped, and size. The projections 113 are unitary with the portion 112. In other embodiments, the projections 113 are assembled with the portion 112, such as via fastening, magnetizing, adhering, mating, interlocking, and others. The projections 113 are solid, but can be hollow.

Figure 12A:
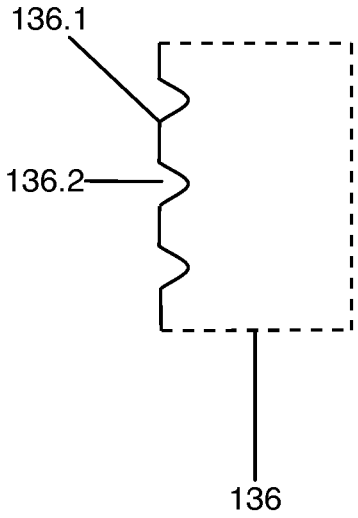
FIG. 12A shows a profile view of an example embodiment of a portion of the key cap defining a plurality of depressions according to the present disclosure.

FIG. 12A shows a profile view of an example embodiment of a portion of the key cap defining a plurality of depressions according to the present disclosure. Some elements of this figure are described above. Thus, same reference characters identify identical and/or like components described above and any repetitive detailed description thereof will hereinafter be omitted or simplified in order to avoid complication.

The portion 136 includes an inner surface 136.1, which defines a plurality of depressions 136.2 therein. The depressions 136.2 are identical to each other in shape and size. In other embodiments, the depressions 136.2 are different from each other in at least one of shape and size.

Figure 12B:
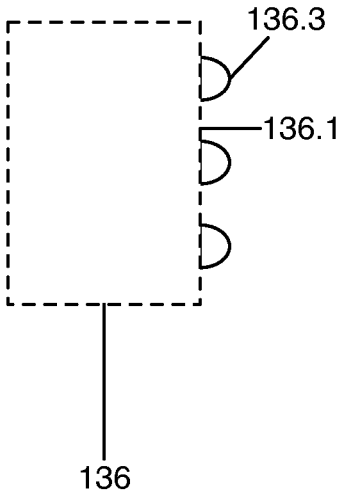
FIG. 12B shows a profile view of an example embodiment of a portion of the key cap including a plurality of projections according to the present disclosure.

FIG. 12B shows a profile view of an example embodiment of a portion of the key cap including a plurality of projections according to the present disclosure. Some elements of this figure are described above. Thus, same reference characters identify identical and/or like components described above and any repetitive detailed description thereof will hereinafter be omitted or simplified in order to avoid complication.

The surface 136.1 includes a plurality of projections 136.3, which are elongated and hemispherical. The projections 136.3 are identical to each other in shape and size. In other embodiments, the projections 136.3 are different from each other in at least one of shape, such as cone-shaped, and size. The projections 136.3 are unitary with the surface 136.1. In other embodiments, the projections 136.3 are assembled with the surface 136.1, such as via fastening, magnetizing, adhering, mating, interlocking, and others. The projections 136.3 are solid, but can be hollow.

In one example mode of operation, the platform 108 includes the protrusions 113 and the surface 136.1 includes the depressions 136.2. The protrusions 113 are complimentarily positioned within the depressions 136.2 in the chamber 132 such that the cap 126 is more securely mounted onto the first structure 102.

In another example mode of operation, the platform 108 includes the depressions 112.1 and the surface 136.1 includes the protrusions 136.3. The protrusions 136.3 are complimentarily positioned within the depressions 112.1 in the chamber 132 such that the cap 126 is more securely mounted onto the first structure 102.

The description of the present disclosure has been presented for purposes of illustration and description. The description of the present disclosure is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

What is claimed is:

1. A musical keyboard comprising:

a first T-shaped structure defined via a first leg and a first platform;

a key cap with an interior open chamber, wherein said key cap is mounted onto said first T-shaped structure such that said interior open chamber contains said first platform; and a second T-shaped structure defined via a second leg and a second platform, wherein said first leg vertically moves within said second leg such that said key cap travels between a non-pressed position and a pressed position, wherein said key cap is raised above said second platform in said non-pressed position, wherein said key cap is in contact with said second platform in said pressed position, wherein said key cap defines a first interior closed chamber containing a first gel and a second interior closed chamber, wherein said interior open chamber is disposed underneath said first interior closed chamber, wherein said first interior closed chamber is interposed between said second interior closed chamber and said interior open chamber.

2. The musical keyboard of claim 1, wherein said second platform is perimetrically greater than said first platform.

3. The musical keyboard of claim 1, wherein said key cap is elastic.

4. The musical keyboard of claim 1, wherein said key cap is frustum-shaped.

5. The musical keyboard of claim 1, wherein said first platform has a pair of opposing sides flush with said first leg.

6. The musical keyboard of claim 1, wherein said second leg defines an open section through which said first leg is accessible.

7. The musical keyboard of claim 1, wherein said second interior closed chamber contains a second gel.

8. The musical keyboard of claim 7, wherein at least one of said first gel and said second gel is cushioning.

9. The musical keyboard of claim 1, wherein said first platform includes a plurality of protrusions, wherein said key cap includes a plurality of depressions, wherein said protrusions are complimentarily positioned within said depressions in said interior open chamber such that said key cap is more securely mounted onto said first T-shaped structure.

10. The musical keyboard of claim 1, wherein said key cap includes a plurality of protrusions, wherein said first platform includes a plurality of depressions, wherein said protrusions are complimentarily positioned within said depressions in said interior open chamber such that said key cap is more securely mounted onto said first T-shaped structure.

11. The musical keyboard of claim 1, wherein said first T-shaped structure, said key cap, and said second T-shaped structure are part of a piano.

12. The musical keyboard of claim 11, wherein said second interior closed chamber contains a second gel.

13. The musical keyboard of claim 12, wherein at least one of said first gel and said second gel is cushioning.

14. The musical keyboard of claim 1, wherein said first platform has a pair of opposing sides flush with said first leg, wherein said second leg defines an open section through which said first leg is accessible.

15. A standalone keyboard comprising:

a first T-shaped structure defined via a first leg and a first platform;

an elastic key cap with an interior open chamber, wherein said key cap is mounted onto said first T-shaped structure such that said interior open chamber contains said first platform; and a second T-shaped structure defined via a second leg and a second platform, wherein said second platform is perimetrically greater than said first platform, wherein said first leg vertically moves within said second leg such that said key cap travels between a non-pressed position and a pressed position, wherein said key cap is raised above said second platform in said non-pressed position, wherein said key cap is in contact with said second platform in said pressed position, wherein said key cap defines a first interior closed chamber containing a first gel and a second interior closed chamber, wherein said interior open chamber is disposed underneath said first interior closed chamber, wherein said first interior closed chamber is interposed between said second interior closed chamber and said interior open chamber.

16. The standalone keyboard of claim 15, wherein said key cap is frustum-shaped.

17. The standalone keyboard of claim 15, wherein said first platform has a pair of opposing sides flush with said first leg.

18. The standalone keyboard of claim 15, wherein said second leg defines an open section through which said first leg is accessible.

19. The standalone keyboard of claim 15, wherein said first platform includes a plurality of protrusions, wherein said key cap includes a plurality of depressions, wherein said protrusions are complimentarily positioned within said depressions in said chamber such that said key cap is more securely mounted onto said first structure.

20. A wireless typing keyboard comprising:

a first T-shaped structure defined via a first leg and a first platform;

a key cap with an interior open chamber, wherein said key cap is mounted onto said first T-shaped structure such that said interior open chamber contains said first platform; and a second T-shaped structure defined via a second leg and a second platform, wherein said first leg vertically moves within said second leg such that said key cap travels between a non-pressed position and a pressed position, wherein said key cap is raised above said second platform in said non-pressed position, wherein said key cap is in contact with said second platform in said pressed position, wherein said key cap defines a first interior closed chamber containing a first gel and a second interior closed chamber, wherein said interior open chamber is disposed underneath said first interior closed chamber, wherein said first interior closed chamber is interposed between said second interior closed chamber and said interior open chamber.

* * * * *